US005626251A

United States Patent [19]

Luburic et al.

[11] Patent Number: 5,626,251

[45] Date of Patent: May 6, 1997

[54] CONTAINER LID

[75] Inventors: Frano Luburic, Fullerton; Dennis R. Willis, Corona, both of Calif.

[73] Assignee: Ropak Corporation, Fullerton, Calif.

[21] Appl. No.: 497,596

[22] Filed: Jun. 30, 1995

Related U.S. Application Data

[63] Continuation of Ser. No. 60,215, May 7, 1993, abandoned.

[51] Int. Cl.[6] ..... B65D 17/40

[52] U.S. Cl. ..... 220/276; 215/256

[58] Field of Search ..... 220/276, 270; 215/256

[56] References Cited

U.S. PATENT DOCUMENTS

| | | | |
|---|---|---|---|
| 1,326,813 | 12/1919 | Wales . | |
| 1,605,228 | 11/1926 | Hammer . | |
| 3,463,341 | 8/1969 | Fields . | |
| 3,831,798 | 8/1974 | Rowe et al. . | |
| 4,113,136 | 9/1978 | Abbott . | |
| 4,190,175 | 2/1980 | Allen . | |
| 4,212,409 | 7/1980 | Jeppsson . | |
| 4,349,174 | 9/1982 | Obrist et al. | 249/58 |
| 4,385,708 | 5/1983 | Curry . | |
| 4,423,822 | 1/1984 | Powalowski . | |
| 4,474,304 | 10/1984 | Jacobs . | |
| 4,711,364 | 12/1987 | Letica . | |
| 4,724,977 | 2/1988 | Cleevely et al. . | |
| 4,735,337 | 4/1988 | Von Holdt | 220/276 |
| 4,798,301 | 1/1989 | Bullock et al. . | |
| 4,881,656 | 11/1989 | Chumley et al. . | |
| 4,930,656 | 6/1990 | Blanchette | 220/276 |
| 4,934,554 | 6/1990 | Edwards . | |
| 4,951,836 | 8/1990 | Yoshimura et al. | 220/276 X |
| 4,976,369 | 12/1990 | Shindo et al. | 220/276 X |
| 5,050,754 | 9/1991 | Marino | 220/276 X |
| 5,092,478 | 3/1992 | La Pierre | 220/276 X |
| 5,238,135 | 8/1993 | Landis | 220/276 |

FOREIGN PATENT DOCUMENTS

| | | | |
|---|---|---|---|
| 2416170 | 10/1979 | France | 220/276 |
| 2842293 | 2/1980 | Germany | 220/276 |
| 254563 | 10/1989 | Japan | 220/276 |
| 127958 | 10/1961 | New Zealand . | |
| 169030 | 6/1974 | New Zealand . | |
| 183470 | 9/1978 | New Zealand . | |
| 213354 | 10/1987 | New Zealand . | |
| 2115392 | 9/1983 | United Kingdom | 220/276 |
| 2219284 | 12/1989 | United Kingdom | 220/276 |

*Primary Examiner*—Jes F. Pascua
*Attorney, Agent, or Firm*—J. Mark Holland

[57] ABSTRACT

A container lid is characterized by a tamper-evidencing tear-strip member having a tab that protrudes from a plane formed by adjacent portions of the lid. The tab preferably includes gripping rib members on opposing surfaces of the tab and is surrounded by a sufficient gap to permit the tab to be readily grasped for easier removal of the tear-strip member from the lid, prior to initial removal of the lid from the container. In container and lid embodiments that are substantially rectangular, the lid also preferably includes mating engagement structure between the lid and the container which is interrupted or not present at the corners of the lid. The tear-strip in this rectangular embodiment also preferably includes a widened portion at the corners, whereby the removal of the tear-strip results in a "scalloping" of the corners. These features on rectangular embodiments facilitate easier attachment and removal of the lid to and from the container, after the removal of the tear-strip.

11 Claims, 3 Drawing Sheets

CONTAINER LID

This application is a continuation of application Ser. No. 08/060,215, filed May 7, 1993, now abandoned.

BACKGROUND OF THE INVENTION

This invention relates to lids for containers, and specifically to a lid adapted to provide easier use of tamper-evidencing tear-strips and to subsequently provide easier removal of the lid from (and attachment of the lid to) the container.

It is known to use tear-strips on the lids of containers as a means of tamper-evidencing. Prior art tear-strips, however, can sometimes be quite "unfriendly" to persons attempting to legitimately open the containers. Among other things, it is sometimes difficult to even locate the tab or other means for initiating the removal of the tear-strip from the lid. Once located, it can sometimes require the use of a screwdriver or other lever mechanism to "pry" the tab loose so that the tear-strip can be removed. Besides being unduly cumbersome, the use of a screwdriver or similar instrument can damage the container and/or lid, even to the point of destroying the ability of the lid to be appropriately resealed on the container.

Additionally, on lids configured to cover container openings that are substantially rectangular, it can be extremely difficult to remove the lid because, as one corner of the lid is lifted, the other corners "bite in" and engage the container even more forcefully than during normal static engagement. The same problem can exist when a person attempts to reseat the lid on the container.

OBJECTS AND ADVANTAGES OF THE INVENTION:

It is, therefore, an object of our invention to provide a lid for a container which incorporates a centrally disposed cover portion having tamper-evidencing means for indicating whether said lid has been removed from the container. In the preferred embodiment, the tamper-evidencing means includes tab means for initiating the operation of the tamper-evidencing means, with the tab means including at least a portion thereof which protrudes from a plane formed by adjacent portions of the lid. A substantial gap is preferably provided between the protruding portion and certain of the adjacent portions of the lid, to permit a user's fingers to readily grasp the protruding portion.

An additional object of our invention is the provision of a lid of the aforementioned character in which the tab means has opposing surfaces, and tactile gripping means such as a plurality of ribs are disposed on the opposing surfaces. These ribs provide improved frictional contact for a person to grip the tab means and manipulate the tamper-evidencing tear-strip.

The aforesaid protrusion and gap and gripping ribs can help persons to more readily locate the tab means, both visually or by feel. Perhaps more importantly, those features permit persons to more readily break loose the tab means and remove the tear-strip from the container, so that the lid can be removed and the contents of the container can be utilized.

A further object of our invention is the provision of a lid of the aforementioned character, in which the protruding portion of the tab means is originally molded in the plane formed by the aforesaid adjacent portions of the lid, and subsequently moves from that plane into the non-planar alignment. This simplifies the design, molding and manufacturing processes (such as in plastic injection molding), and can result in economic savings to the manufacturer.

Another object of our invention is the provision of a lid of the aforementioned character in which the tamper-evidencing means includes a tear-strip member disposed at the periphery of the lid, with tab means operatively affixed to the tear-strip member. The operative affixation may be accomplished, for example, by integrally molding the tab and the tear-strip member.

Yet another object of our invention is the provision of a lid of the aforementioned character in which the lid and the corresponding container opening are of substantially rectangular configuration, and the tear-strip member includes corner extension means at the corners of the lid for permitting greater flexure of the lid at the corners after removal of the tear-strip member. Each of the corner extension means preferably includes a section of the tear-strip member that is wider than adjacent sections of the tear-strip member. The removal of these wider sections during removal of the tear-strip results in a "scalloping" of the corners and a corresponding increased flexibility in the lid, providing easier removal and attachment of the lid.

Additionally with respect to embodiments of substantially rectangular configuration, it is an object of our invention to provide a lid of the aforementioned character that includes retaining means for retaining the lid on the container, and the retaining means is not present at one or more of the corners of the rectangular lid. This feature also prevents the undesired "biting in" of remote corners as one corner is lifted during removal of the lid from the container.

It is yet another object of our invention to provide a substantially rectangular container lid which includes a centrally disposed cover portion having an inverted generally U-shaped cover edge, with the U-shaped edge forming a groove for receiving an upper edge of a side wall of the container. The lid further includes a tear-strip member disposed at the periphery of the lid and having a widened section at one or more of the corners. The tear-strip member includes tab means for initiating the operation of the tamper-evidencing means. The tab means includes at least a portion protruding from a plane formed by adjacent portions of the lid, and includes tactile gripping means for providing an improved frictional contact for a person to grip the tab means. The lid further includes retaining means for retaining the lid on the container, with the retaining means on the lid being interrupted or otherwise not present at one or more of the corners of the lid. These features greatly facilitate the initial and subsequent removal and attachment of the lid to the container.

Other objects and advantages of the invention will be apparent from the following specification and the accompanying drawings, which are for the purpose of illustration only.

Figure 1:
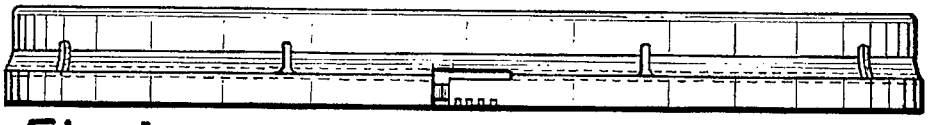
Fig. 1. PRIOR ART
FIG. 1 is a side elevation view of a prior art lid and tab means.
Figure 2:
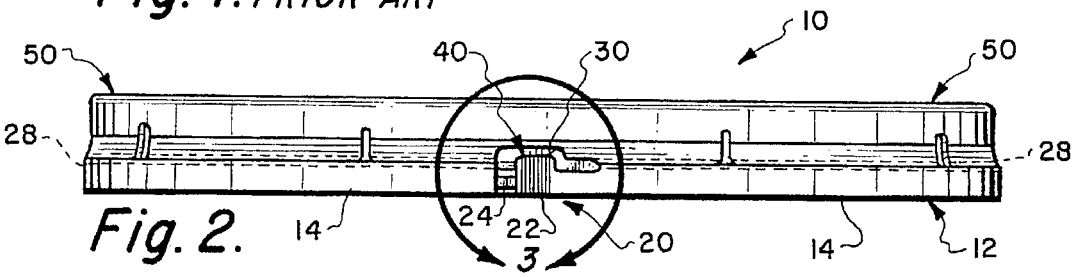
FIG. 2 is a side elevation view similar to FIG. 1, but illustrating a lid constructed in accordance with the teachings of the invention.
Figure 3:
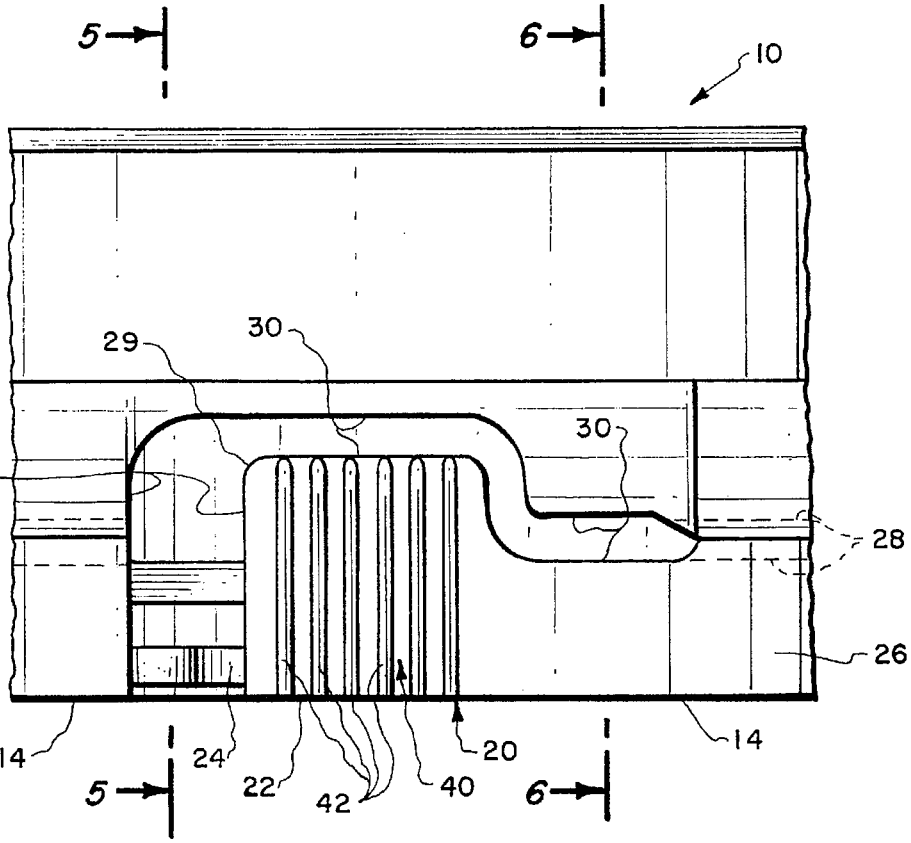
FIG. 3 is an enlarged view of the portion of FIG. 2 delineated by line 3.
Figure 7:
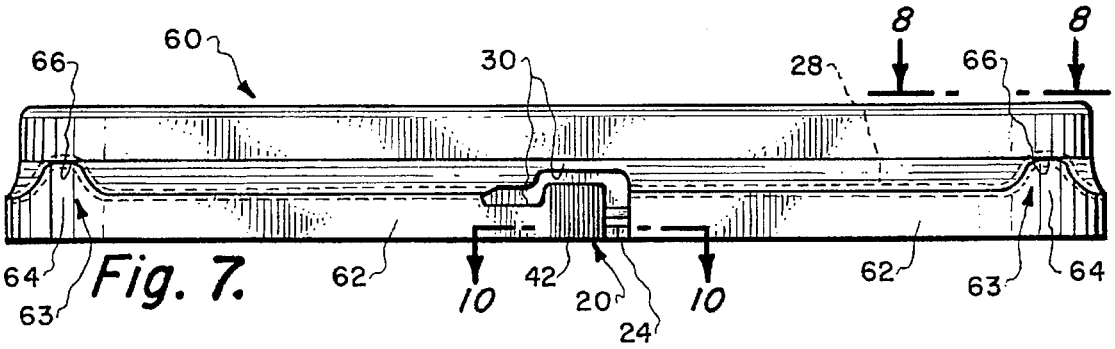
FIG. 7 is a side elevation view similar to FIG. 2, but illustrating a substantially rectangular lid constructed in accordance with the teachings of the invention.

DESCRIPTION OF PREFERRED EMBODIMENT:

Referring to the drawings, and particularly to FIGS. 2–6 thereof, we show a lid 10 constructed in accordance with the teachings of the invention and including tamper-evidencing means 12, shown as a tear-strip member 14. Those skilled in the art will understand that the tamper-evidencing means indicates whether the lid has been removed from its associated container (a container is not illustrated in FIGS. 2–6) after the original assembly of the lid 10 onto a container.

Figure 8:
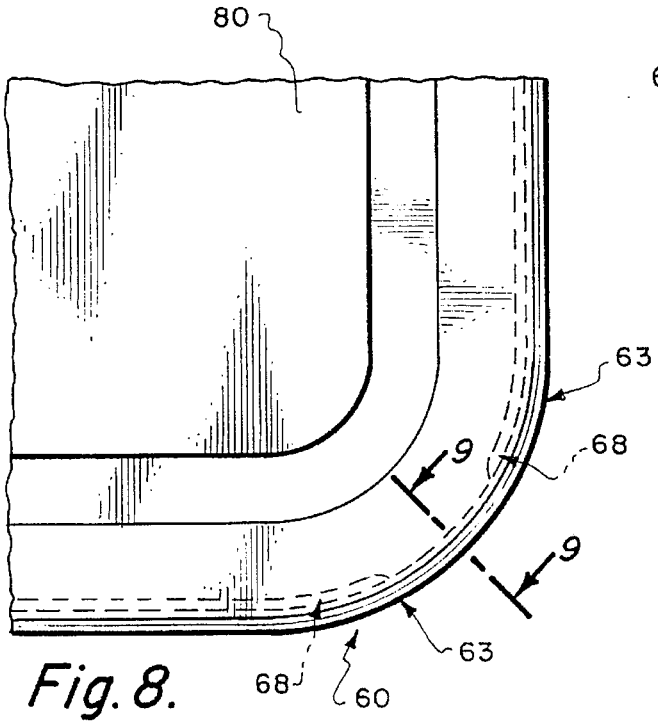
FIG. 8 is a top view of one corner of the lid of FIG. 8, taken along line 8—8 of FIG. 7.
Figure 12:
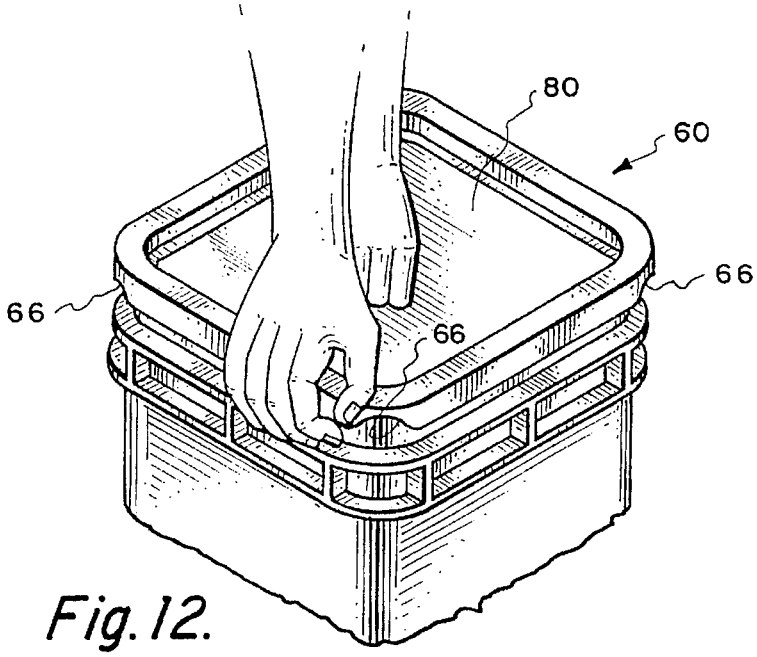
FIG. 12 is an isometric view of a lid similar to the lids illustrated in FIGS. 7–11, but illustrating how a person might attach or remove the lid to or from a container after the tear-strip member has been completely removed from the lid.

Those skilled in the art will further understand that the lid includes a centrally disposed cover portion similar to that illustrated as portion 80 in FIGS. 8 and 12. The lid is preferably lightweight with some degree of resilience, to resist damage during handling and use and to permit operative repetitive engagement with a container. The lid may be fabricated from any suitable material and by any suitable process, but is preferably manufactured from plastic in an injection molding process.

The lid 10 may be of any suitable size and shape so as to correspond to an associated container, but is illustrated in a circular configuration in the FIGS. 2–6.

The tamper-evidencing means 12 preferably includes tab means 20, which is preferably integrally molded with tear-strip member 14, but which may be operatively attached to the tear-strip member 14 by any suitable means such as gluing, stapling, bolting, welding or the like. In the preferred embodiment, the tab means 20 includes a central body portion 22, a frangible or breakable connecting portion 24, and a relatively non-breakable connecting portion 26. The connecting portions 24 and 26 maintain the tab means 20 in operative relationship with the lid 10 and the tear-strip member 14, with the frangible connecting portion 24 dimensioned and configured to permit fracture thereof when a person wants to remove the tear-strip member 14, as more thoroughly described herein. The relatively non-breakable connecting portion 26, in contrast, is dimensioned and configured to withstand the forces exerted thereon by the person pulling on the tab means 20 during removal of the tear-strip member 14.

Figure 11:
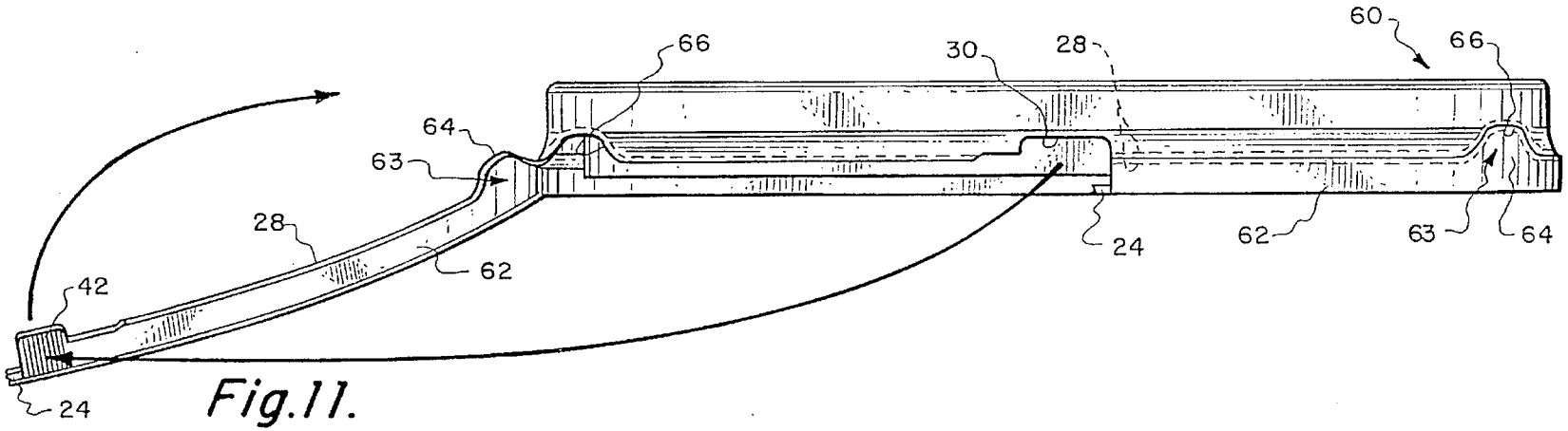
FIG. 11 is a side elevation view similar to FIG. 7, but illustrating a substantially rectangular lid constructed in accordance with the teachings of the invention with the tear-strip member partially separated from the lid.

As indicated above, the tab means 20 is utilized to initiate the removal of the tamper-evidencing tear-strip member 14 from the assembled lid 10 and container. This is preferably accomplished by a person grasping the tab means 20, exerting sufficient pressure to break the connecting portion 24, and subsequently "peeling" the tear-strip 14 from the lid 10 along an integrally-molded scoreline 28 (best illustrated in FIG. 6). This removal process is further illustrated in FIG. 11 (showing a tear-strip partially removed from a lid) and in FIG. 12 (showing a lid on a container after the tear-strip has been removed from the assembly).

Figure 5:
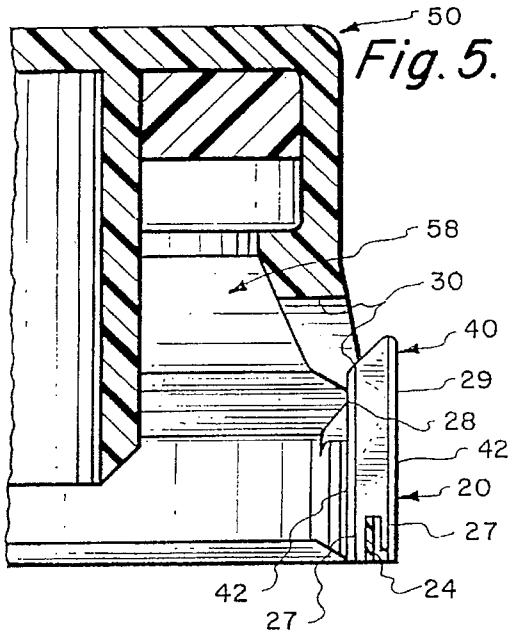
FIG. 5 is a sectional view, taken along line 5—5 of FIG. 3.

In order to make the tab means 20 easier to locate (by sight or by touch), the tab means preferably includes a protruding portion 29 (as best illustrated in FIG. 5) which protrudes from a plane formed by adjacent portions of the lid. This protrusion enables a user to more readily see the tab means 20 while initially opening the container, and also to feel the tab means, especially in situations where lighting and/or location of the container/lid assembly require that the user locate the tab means by feel instead of sight.

Figure 4:
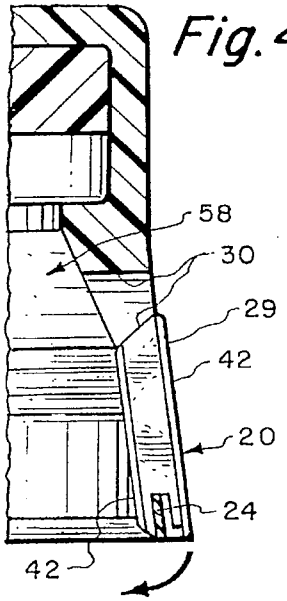
FIG. 4 is a sectional view, similar to that of FIG. 5 but illustrating the coplanar alignment of the tab means as it preferably appears during manufacture.

To facilitate manufacture of the lid 10 through processes such as injection molding, the protruding portion 29 is preferably molded "in-line" or co-planar with the adjacent portions of the lid. As illustrated in FIG. 4, the mold in such a process can be configured without the more complicated shape of FIG. 5, and upon removal of the lid 10 from the mold, several factors can combine to accomplish the desired protrusion of portion 29. These include the natural shrinkage of the plastic material from which the lid is formed and the relatively greater flexibility of the breakable connecting portion 22. These factors permit the lower edge of the tear-strip member 14 and the tab means 20 to "shrink" inwardly, as indicated by arrow "A" in FIG. 4. As such shrinkage occurs, the protruding portion 29 correspondingly moves out of the coplanar alignment with the adjacent portions of the lid 10, and into the non-aligned position shown in FIG. 5.

This outward movement of the protruding portion 29 is further facilitated by the provision of a substantial gap 30 between the protruding portion 29 and certain of the adjacent portions of the lid 10. The gap 30 is additionally sufficiently large and appropriately shaped to permit a user's fingers to readily grasp the protruding portion 29 to facilitate removal of the tear-strip member 14.

To further enable to operative removal of the tear-strip member 14 from the lid 10, the tab means 20 also preferably includes tactile gripping means 40 such as a plurality of ribs 42 for providing an improved frictional contact for a person to grip the tab means 20. Those skilled in the art will understand that the tactile gripping means 40 may be provided in any of a wide variety of other embodiments (not shown), including a toughened surface, holes in the tab means 20, an adhesive-coating on the tab means 20, or the like. In the preferred embodiment, the tab means 20 has opposing surfaces 27, FIG. 5, and the tactile gripping means 40 are disposed on both opposing surfaces 27.

Figure 6:
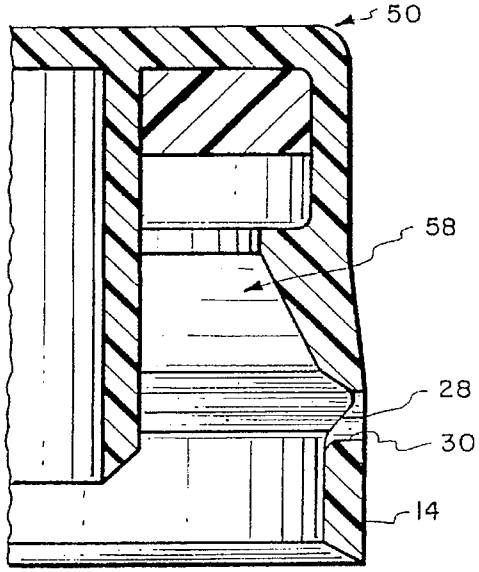
FIG. 6 is a sectional view, taken along line 6—6 of FIG. 3.

As illustrated, the tear-strip member 14 is preferably disposed at the periphery of the lid 10. The lid 10 has an inverted generally U-shaped cover edge 50, as best illustrated in FIGS. 5 and 6. The U-shaped edge 50 forms a groove for receiving an upper edge of a side wall of the container (not shown). The lid 10 further includes retaining means 58 for retaining the lid on the container. As illustrated, the retaining means 58 includes an engagement lip configured to matingly engage a correspondingly-shaped lip on the container (not shown) when the lid 10 and container are assembled with each other.

In embodiments in which the lid 60 is of substantially rectangular configuration to cover a correspondingly-shaped opening in a container, FIGS. 7–12, the tear-strip member 62 of the lid 60 further includes corner extension means 63. In the preferred embodiment, corner extension means 63 includes one or more sections 64 of the tear-strip member 62 at one or more of the corners of the lid 60. The sections 64 are wider than adjacent sections of said tear-strip member 62, and are preferably defined by the scoreline 28 so that tearing the tear-strip member 62 from the lid 60 results in a "scalloping" of the corners of the lid 60. In other words, upon removal of the tear-strip member 62 from the lid 60, these widened sections 64 leave corresponding scalloped sections 66 in the lid 60, permitting a greater flexure of the lid 60 during removal from or attachment to the container (see FIG. 12) than would be possible without the one or more widened sections 64. This increased flexure provides correspondingly easier removal and attachment of the lid 60 from and to the container.

Figure 9:
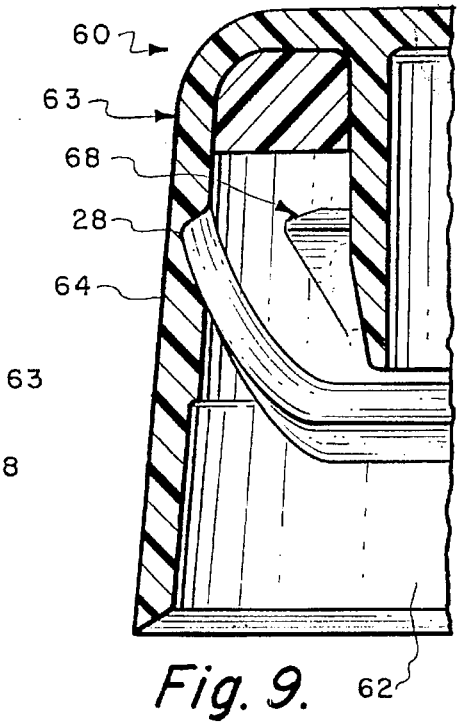
FIG. 9 is a sectional view, taken along line 9—9 of FIG. 8.
Figure 10:
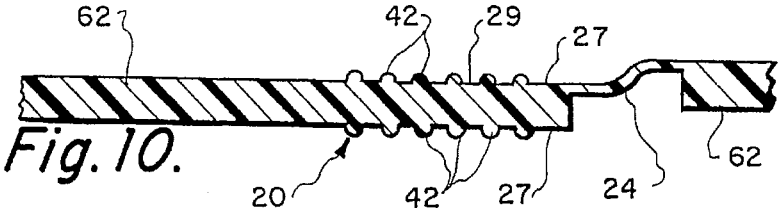
FIG. 10 is a sectional view of the tab means of FIG. 7, taken along line 10—10 of FIG. 7.

Also in embodiments of substantially rectangular configuration, the lid 60 further includes retaining means 68 similar to the retaining means 58 described above in relation to FIGS. 2–6. The retaining means 68 is for retaining the lid on the container, but in the substantially rectangular embodiment of FIGS. 7–12, the retaining means 68 is not present at one or more of the corners of the rectangular lid. For example, in embodiments where the retaining means 68 is a substantially continuous lip about the periphery of the lid 60, that lip is interrupted or is otherwise absent at the corners of the lid (as best illustrated in FIGS. 8 and 9).

The absence of the retaining means 68 at the corners of the lid 60 ensures that, when one corner of the lid is lifted, FIG. 12, there is no retaining lip at the other corners to "bite in" and more firmly engage the container. As those skilled in the art will understand, flexure of the lid from one corner, FIG. 12, would cause adjacent corners of prior art lids to pull inwardly against the container, enhancing the engagement between the mating retaining lips of the lid and the container. The present invention not only permits more ready flexure of the lid (by the provision of the scalloped sections 66, as described above), but prevents the undesirable increased interengagement at the corners of the assembled lid and container.

Thus, by our invention we provide a container lid which permits the easier identification, location and removal of tamper-indicating means such as an encircling tear-strip member, and also facilitates subsequent attachment and removal of the lid to the container for substantially rectangular lids.

The lid of our invention has been described with some particularity but the specific designs and constructions disclosed are not to be taken as delimiting of the invention in that various obvious modifications will make themselves apparent to those of ordinary skill in the art, all of which will not depart from the essence of the invention and all such changes and modifications are intended to be encompassed within the appended claims.

We claim:

1. A container and mating lid, said container having an opening and an externally projecting bead disposed about said opening to help retain said lid over said opening, said lid including a centrally disposed cover portion having tamper-evidencing means for indicating whether said lid has been removed from said container, said lid further including a downwardly projecting peripheral skirt having a lower edge, said tamper-evidencing means including tab means for initiating the operation of said tamper-evidencing means, said tab means having a lower edge which lies substantially along a line between adjacent portions of said lid prior to initiating the operation of said tamper-evidencing means, said tab means projecting upwardly from said lower edge of said skirt and including at least a portion thereof which protrudes from a plane formed by adjacent portions of said lid, said tab means having one or more edges spaced upwardly from said lower edge of said skirt, an uppermost of said one or more edges on said tab means extending upwardly beyond a portion of said lid to which said tab means is attached, said downwardly projecting peripheral skirt further including an opening contiguous to said tab means to facilitate a user gripping said tab means, said opening adjacent said tab means being defined at least in part by a defining edge, said defining edge being spaced from said one or more edges of said tab means in one or more directions lying in said plane formed by adjacent portions of said lid, said downwardly projecting peripheral skirt including inwardly protruding lip means configured to matingly engage said externally projecting bead on said container, said tamper-evidencing means including a tear-strip member disposed at the periphery of said lid, said tab means being operatively affixed to said tear-strip member, in which said lid and the container opening covered thereby are substantially rectangular, and said tear-strip member includes corner extension means at the corners of said lid for permitting greater flexure of said lid at said corners after removal of said tear-strip member.

2. The container and mating lid of claim 1, in which each of said corner extension means includes a section of said tear-strip member that is wider than adjacent sections of said tear-strip member.

3. A container and mating lid, said container having an opening and an externally projecting bead disposed about said opening to help retain said lid over said opening, said lid including a centrally disposed cover portion having tamper-evidencing means for indicating whether said lid has been removed from said container, said lid further including a downwardly projecting peripheral skirt having a lower edge, said tamper-evidencing means including tab means for initiating the operation of said tamper-evidencing means, said tab means having a lower edge which lies substantially along a line between adjacent portions of said lid prior to initiating the operation of said tamper-evidencing means, said tab means projecting upwardly from said lower edge of said skirt and including at least a portion thereof which protrudes from a plane formed by adjacent portions of said lid, said tab means having one or more edges spaced upwardly from said lower edge of said skirt, an uppermost of said one or more edges on said tab means extending upwardly beyond a portion of said lid to which said tab means is attache& said downwardly projecting peripheral skirt further including an opening contiguous to said tab means to facilitate a user gripping said tab means, said opening adjacent said tab means being defined at least in part by a defining edge, said defining edge being spaced from said one or more edges of said tab means in one or more directions lying in said plane formed by adjacent portions of said lid, said downwardly projecting peripheral skirt including inwardly protruding lip means configured to matingly engage said eternally projecting bead on said container, in which said lid and the container opening covered thereby are of substantially rectangular configuration, and said inwardly protruding lip means on said lid is not present at at least one of the comers of said rectangular lid.

4. The container and mating lid of claim 3, in which said tear-strip member includes comer extension means at the corners of said lid for permitting greater flexure of said lid at said corners after removal of said tear-strip member.

5. The container and mating lid of claim 4, in which each of said corner extension means includes a section of said tear-strip member that is wider than adjacent sections of said tear-strip member.

6. The container and mating lid of claim 1 or claim 3, in which said tab means has opposing surfaces having tactile gripping means thereon.

7. The container and mating lid of claim 1 or claim 3, in which said protruding portion thereof assumes its protruding characteristic only after manufacture of said lid.

8. A container and mating lid, said container having an opening therein and having an upwardly extending sidewall portion substantially therearound, said sidewall portion defining one or more comer sections, said lid being configured to engage said sidewall portion and to cover said opening, said lid including a centrally disposed cover portion having an inverted generally U-shaped edge, said U-shaped edge forming a groove for receiving an upper edge of said sidewall of said container, said lid further including a tear-strip member at the periphery of said lid, said tear-strip member having a widened section at at least one of said comers, whereby removal of said tear-strip member permits greater flexure of said lid during removal from or attachment to said container than without said at least one widened sections, in which said tear-strip member includes tab means for initiating the operation of said tamper-evidencing means, said tab means including at least a portion thereof which protrudes from a plane formed by adjacent portions of said lid, said tear-strip member being formed as part of a downwardly projecting skirt about said lid and said tab means being operatively connected to said tear-strip member to initiate tearing thereof from said lid, said tab means having one or more edges spaced upwardly from a lower edge of said skirt, an uppermost of said one or more edges on said tab means extending upwardly beyond the height of said adjacent tear-strip member.

9. The container and mating lid of claim 8, in which said lid further includes retaining means for retaining said lid on said container, said retaining means including a lip substantially about the periphery of said lid, said lip being configured to matingly engage a corresponding lip on said container, and said lip is not present at one or more of the comers of said lid.

10. A container and mating lid, said container having an opening therein and having an upwardly extending sidewall portion substantially therearound, said sidewall portion defining one or more comer sections, said lid being configured to engage said sidewall portion and to cover said opening, said lid including a centrally disposed cover portion having an inverted generally U-shaped edge, said U-shaped edge forming a groove for receiving an upper edge of said sidewall of said container, said lid further including a tear-strip member at the periphery of said lid, said tear-strip member having a widened section at at least one of said comers, whereby removal of said tear-strip member permits greater flexure of said lid during removal from or attachment to said container than without said at least one widened sections, in which said tear-strip member includes tab means for initiating the operation of said tamper-evidencing means, said tab means including at least a portion thereof which protrudes from a plane formed by adjacent portions of said lid, said tear-strip member being formed as part of a downwardly projecting skirt about said lid and said tab means being operatively connected to said tear-strip member to initiate tearing thereof from said lid, said tab means having one or more edges spaced upwardly from a lower edge of said skin, said downwardly projecting peripheral skirt further including an opening contiguous to said tab means to facilitate a user gripping said tab means, said opening adjacent said tab means being defined at least in part by a defining edge, said defining edge being spaced from said one or more edges of said tab means in one or more directions lying in said plane formed by adjacent portions of said lid.

11. The container and lid of claim 8 or claim 9 or claim 10, in which said opening in said container is substantially rectangular.

* * * * *

UNITED STATES PATENT AND TRADEMARK OFFICE

CERTIFICATE OF CORRECTION

PATENT NO. : 5,626,251

DATED : May 6, 1997

INVENTOR(S) : Frano Luburic, Dennis R. Willis

It is certified that error appears in the above-indentified patent and that said Letters Patent is hereby corrected as shown below:

Column 4, line 43, "to operative removal" should read --the operative removal--.

Column 4, line 50, "toughened" should read --roughened--.

Column 6, line 50, in Claim 3, "attache&" should read --attached,--.

Column 6, line 63, in Claim 3, "comers" should read --corners--.

Column 6, line 65, in Claim 4, "comer" should read --corner--.

Column 7, line 14, in Claim 8, "comer" should read --corner--.

UNITED STATES PATENT AND TRADEMARK OFFICE

CERTIFICATE OF CORRECTION

PATENT NO. : 5,626,251

DATED : May 6, 1997

INVENTOR(S) : Frano Luburic, Dennis R. Willis

It is certified that error appears in the above-indentified patent and that said Letters Patent is hereby corrected as shown below:

Column 7, line 22, in Claim 8, "comers" should read --corners--.

Column 8, line 4, in Claim 9, "comers" should read --corners--.

Column 8, line 8, in Claim 10, "comer" should read --corner--.

Column 8, line 16, in Claim 10, "comers" should read --corners--.

Column 8, line 28, in Claim 10, "skin" should read --skirt--.

Signed and Sealed this

Fourteenth Day of October, 1997

*Attest:*

Bruce Lehman

BRUCE LEHMAN

*Attesting Officer*

*Commissioner of Patents and Trademarks*